US006134855A

United States Patent [19]

Beck

[11] Patent Number: 6,134,855

[45] **Date of Patent: *Oct. 24, 2000**

[54] APPARATUS AND METHOD OF APPLYING BUILDING PANELS TO SURFACES

[75] Inventor: David H. Beck, Jackson, Mich.

[73] Assignee: CertainTeed Corporation, Valley Forge, Pa.

[ * ] Notice: This patent is subject to a terminal disclaimer.

[21] Appl. No.: 09/090,529

[22] Filed: Jun. 4, 1998

Related U.S. Application Data

[63] Continuation-in-part of application No. 08/991,868, Dec. 16, 1997, Pat. No. 5,887,403, which is a continuation of application No. 08/242,716, May 13, 1994, Pat. No. 5,729, 946.

[51] Int. Cl.[7] ..... E04D 1/34

[52] U.S. Cl. ..... 52/520; 52/519; 52/521; 52/523; 52/547; 52/747.1; 52/748.1

[58] Field of Search ..... 52/547, 549, 555, 52/520, 518, 519, 521, 523, 539, 543, 747.1, 748.1

[56] References Cited

U.S. PATENT DOCUMENTS

| | | | |
|---|---|---|---|
| 2,961,804 | 11/1960 | Beckman . | |
| 3,174,256 | 3/1965 | Lockwood | 52/547 X |
| 3,343,325 | 9/1967 | Curran . | |
| 3,738,076 | 6/1973 | Kessler . | |
| 3,757,483 | 9/1973 | Torbett . | |
| 4,104,841 | 8/1978 | Naz | 52/547 X |
| 4,292,781 | 10/1981 | Chalmers et al. . | |
| 4,424,655 | 1/1984 | Trostle . | |
| 4,712,351 | 12/1987 | Kasprzak | 52/549 X |
| 4,782,638 | 11/1988 | Hovind . | |
| 4,947,609 | 8/1990 | Champagne . | |
| 5,016,416 | 5/1991 | Munk . | |
| 5,392,579 | 2/1995 | Champagne . | |
| 5,526,627 | 6/1996 | Beck . | |
| 5,729,946 | 3/1998 | Beck | 52/520 |
| 5,857,303 | 1/1999 | Beck et al. | 52/520 |
| 5,887,403 | 3/1999 | Beck | 52/518 |

FOREIGN PATENT DOCUMENTS 612570 11/1948 United Kingdom .

*Primary Examiner*—Christopher T. Kent
*Attorney, Agent, or Firm*—Paul & Paul

[57] ABSTRACT

An apparatus and method is provided for applying building panels, such as siding panels, to building surfaces, such as walls. The panels are of a type which undergo expansion and contraction due to changes in temperature, and they are applied to a building surface, such as a wall, by means of nails, screws, staples or the like. In order to accommodate the expansion and contraction of the panels, the panels are provided with an attachment hem, such as a strip of relatively flexible material, generally rubber-like or fabric-like in nature. A strip of relatively flexible material may be secured to the relatively rigid building panel by any suitable means, such as adhesive securement, welding, heat fusing, etc., such that it becomes an integral part of the building panel, or the relatively flexible attachment hem may comprise a separate component which, when applied to a building surface, such as a wall or the like, by a suitable nailing, stapling, etc., serves to lock in place the relatively rigid building panel by means of engaging a lip or like portion of the same.

26 Claims, 7 Drawing Sheets

APPARATUS AND METHOD OF APPLYING BUILDING PANELS TO SURFACES

CROSS-REFERENCE TO RELATED APPLICATIONS

This is a continuation-in-part of prior application Ser. No. 08/991,868 filed Dec. 16, 1997, now U.S. Pat. No. 5,887,403, which, in turn, is a continuation of prior application Ser. No. 08/242,716 filed May 13, 1994, now U.S. Pat. No. 5,729,946 issued Mar. 24, 1998.

BACKGROUND OF THE INVENTION

In the art of building construction, it is known to apply relatively rigid building panels, such as siding panels or the like, to a wall of a building. Frequently such panels are constructed of vinyl siding, hardboard, aluminum or the like. In many such instances, the siding, particularly in the case of vinyl siding and aluminum siding, is configured to simulate wood siding construction, and such siding may be extruded, bent, molded or otherwise configured to have lap zones or the like, whereby one edge, such as an upper edge of the panel will be provided with a nailing hem, which hem is in the covered condition after installation by means of the next-applied panel engaging a lap joint of the first-applied panel, and covering the nailing hem of the first-applied panel.

In connection with such prior art application of building panels, it is commonplace that the nailing hem be provided with a slotted hole to accommodate expansion and contraction of the panel due to variations in temperature. Such slotted holes or nailing slots allow the panels to be secured to a wall or other building surface by placing the nail generally in the center of the slot, and hammering it into the building surface, such that, after installation, a given panel is carried by a plurality of nails in similar nailing slots, whereby the panel may free-float on the nails, because the nails are not hammered tightly "home," into the building surface. However, it is not always practical to nail the nails into the center of a nailing slot, and if many nails are nailed toward the end of the nailing slot, the purpose of having a free-floating panel is not achieved, and the desired expansion and contraction in the panel due to changes in temperature will not be accommodated to the extent desirable. Additionally, constantly nailing such relatively "loose" or floating panels provides assembly difficulty. Furthermore, in nailing siding or other panels to building walls, it is inefficient to constantly be concerned about proper placement of the nail in the center of a slotted hole. Other means of assembly, such as power nailing, stapling and the like would be more efficient, if one did not have to be concerned with correct placement of the nail, staple or other fastener relative to the slotted hole.

THE PRESENT INVENTION

The present invention is directed to allowing the fastening of relatively rigid panels, such as siding materials, to the wall of a building without adversely affecting the siding performance. Specifically, the invention allows the normal expansion and contraction of the panels, and allows assembly of panels onto uneven wall surfaces, while still allowing for rigid fastening of the panels to the surfaces.

Most specifically, the present invention employs a relatively flexible attachment member which may be quickly installed onto a wall by means of power nailers, staplers, or other fasteners, which allows for ease of installation without requiring concern over centering the fastener into a nail slot.

The relatively flexible attachment member, in the form of a nail hem or the like, is made of a preferably rubber-like or fabric-like material that stretches or compresses, both of which are hereinafter defined as pliant. In its preferred form, the relatively flexible attachment hem or other member may be made to be integral with the relatively rigid panel member, by being adhesively secured thereto, bonded, fused or welded thereto, or even stapled or mechanically interlocked thereto, etc. or a combination of any of such securement techniques, although the relatively flexible attachment member may, in the alternative, comprise a separate member that partially overlies, or otherwise holds the relatively rigid panel member to a wall. The relatively flexible panel member may, for example, be constructed of polyvinyl chloride, rubber, various polymers, or even fabric, or a combination or mix of any of them, and will have the desired flexibility. Suitable fasteners, such as power nailers, staplers, screws or even adhesives or a combination of any of them may be used to secure the relatively flexible attachment members to a building surface. In the case of steel stud use, in particular, screws may be particularly desirable although other fasteners may be used in addition or instead. In the case of adhesive securement of the relatively flexible attachment member to a building surface, whether or not the attachment member is made integral with or secured to the relatively rigid covering panel prior to installation, the adhesive by which the relatively flexible attachment member is secured to a building wall may, for example, be covered by a release strip of paper, which once removed, allows simply pressing the relatively flexible attachment member into fastening engagement on a building wall.

Accordingly, it is a primary object of this invention to provide an efficient method and apparatus for applying relatively rigid building panels onto building walls, to allow for expansion and contraction of panels without requiring the use of slotted nailing holes.

It is another object of this invention to accomplish the above object, by the use of a relatively flexible attachment member which may be attached to a building wall by relatively rigid fasteners, and which in turn, can either be attached to and carried by a relatively rigid building material panel, or may hold a relatively rigid building material panel to a wall when the relatively flexible attachment member is applied to a building wall.

Other objects and advantages of the present invention will be readily understood by a reading of the brief descriptions of the drawing figures, detailed descriptions of the preferred embodiments, and the appended claims.

BRIEF DESCRIPTION OF THE DRAWING FIGURES

FIG. 6 is another illustration of applying a relatively rigid siding material to a building wall, in which case the siding material comprises hardboard panels having the relatively flexible attachment members secured thereto, which attachment members are in turn fastened to a building wall by means of staples or the like.

Figure 4:
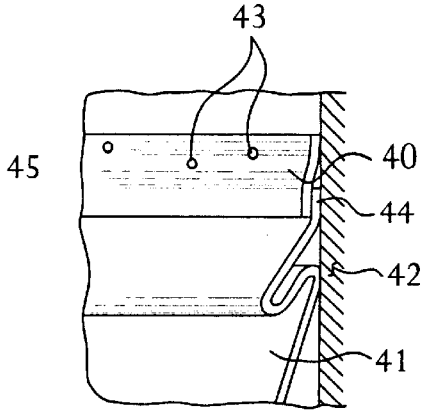
FIG. 4 is a fragmentary illustration of another embodiment of this invention, in which the relatively flexible attachment member is separate from the siding panel, and which secures the siding panel to a building wall.
Figure 5:
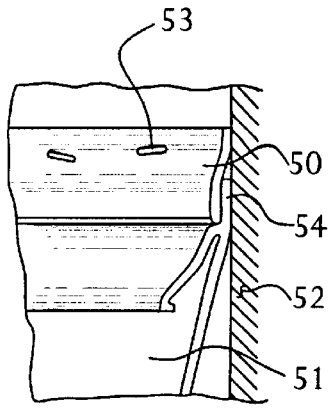
FIG. 5 is an illustration like that of FIG. 4, but wherein the relative rigid siding material is of a different extruded design than that of FIG. 4, and wherein the nailing hem is likewise a separate attachment member holding the relatively rigid siding in place against a building wall.
Figure 25:
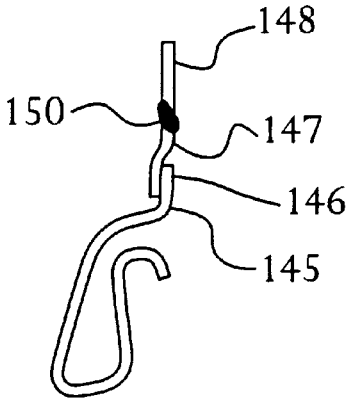

FIG. 25 is another side or edge elevational view of an upper edge of siding of the relatively rigid type, wherein the nailing hem is shown as comprising a relatively flexible siding member secured to a relatively rigid portion at the lower end thereof along a line of fusion, and wherein the relatively rigid portion is adapted to overlay and hold the relatively rigid panel member, without necessarily being secured thereto, in the manner also illustrated in FIGS. 4 and 5.

DETAILED DESCRIPTIONS OF THE PREFERRED EMBODIMENTS

Figure 1:
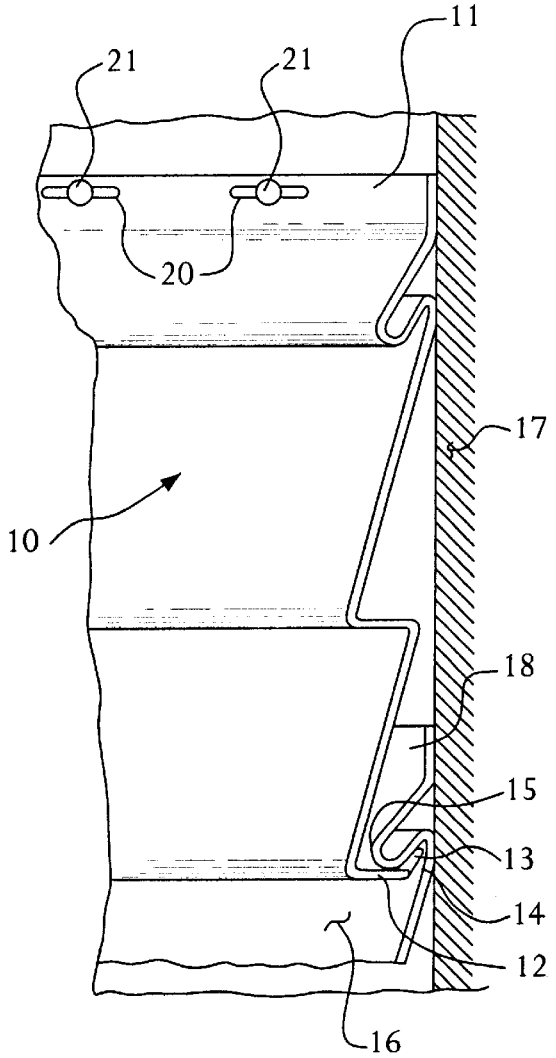
FIG. 1 is a fragmentary perspective view of a prior art siding installation applied to a building wall, whereby nails are placed at the approximate centers of slotted holes and are nailed through the slotted holes into engagement with a building wall, with the slotted holes being located in a nailing hem of the siding panel.

Referring now to the drawings in detail, reference is first made to the prior art illustration of FIG. 1, wherein a relatively rigid siding panel 10 is shown as having upper and lower opposite edge zones 11, 12, respectively, with the lower edge zone 12 having an upwardly extending lip 13, which engages in a groove 14 of a downwardly turned lap joint 15 at the upper edge zone of a next-previously applied siding panel 16, whereby the lower end 12 of the relatively rigid panel 10 is secured against a building wall 17, in that the upper edge zone 18 of the lower panel 16 is fastened to the building wall 17 by suitable nails or the like (not shown).

The upper edge zone 11 of the panel 10 comprises a nailing zone, whereby a plurality of slots 20 are provided, whereby nails 21 may be placed approximately in the center of the slots, and hammered in to the building wall 17, an amount sufficient to hold the panel 10 against the wall, but preferably not hammered "tightly home," to allow the normal expansion and contraction movement of the siding 10 leftward and rightward to accommodate the expansion and contraction caused by variations in temperature, whereby the horizontal slots 20 allow the panel to slide along the nails 21.

Figure 2:
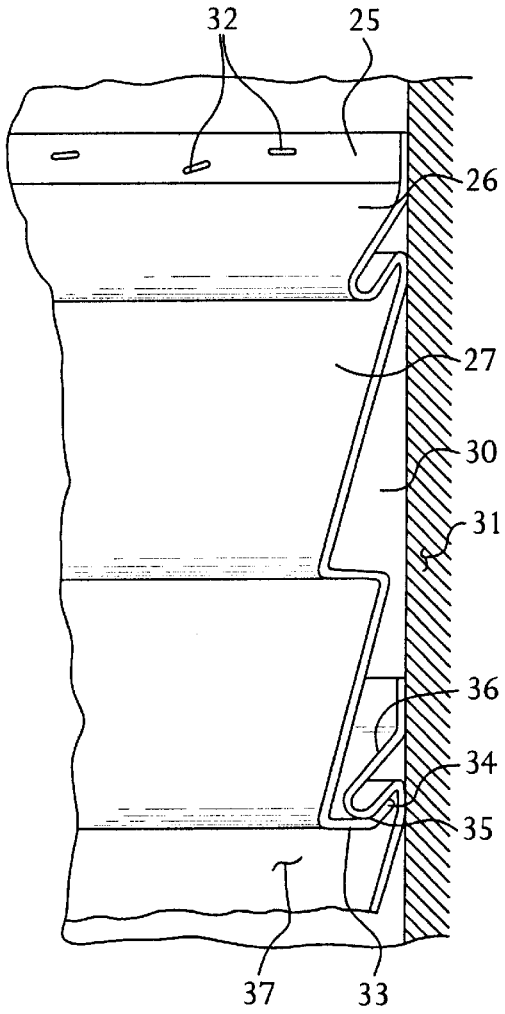
FIG. 2 is an illustration like that of FIG. 1, but wherein the relatively rigid siding panel is provided with a relatively flexible attachment member, fused or otherwise secured thereto, which attachment is then shown as being applied to the building wall by means of relatively rigid fasteners, such as staples.
Figure 3:
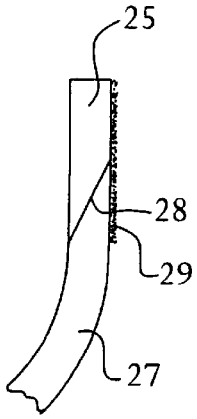
FIG. 3 is a fragmentary enlarged side elevational view of an upper edge of siding, whereby the nailing hem is shown as comprising a relatively flexible siding member secured to the relatively rigid panel member, along a line of fusion, where the relatively flexible material is fused to the relatively rigid material.

With reference now to FIG. 2, there is illustrated a preferred embodiment of the present invention, in which a relatively flexible nailing hem 25 is provided at the upper edge zone 26 of a relatively rigid siding panel 27, fused thereto, as is shown more clearly in FIG. 3, along a fusion line 28, by means of heat fusion, adhesive securement, sonic welding, mechanical interlock or the like. It will also be noted that where the siding panel 27 is an extruded panel, such as a vinyl panel, the relatively flexible attachment hem 25 may be co-extruded as the relatively rigid vinyl panel 27 is extruded. In any event, the relatively flexible attachment member 25 as shown in FIGS. 2 and 3 becomes integral with the relatively rigid panel 27, such that it may be stapled to a surface 30 of a building wall 31, by means of suitable staples such as those 32 delivered from a staple gun, power stapler, or the like, or adhesively applied to a wall 31 by an adhesive 29 on a surface thereof.

It will be noted that, as in the prior art illustration of FIG. 1, the lower edge zone 33 of the panel 27 will have an upwardly extending lip 34, secured in a downwardly opening grove 35 of a lap joint 36 of a next-previously applied panel 37, such that the panel 27 is held against the wall 31 at its lower end, and is fastened to the wall 31 at its upper end by means of the staples 32, as shown.

With reference to FIG. 4, it will be seen that the relatively flexible attachment member 40 is separate from the relatively rigid panel 41, and is applied to the building wall 42 by means of suitable nail-like fasteners 43 or the like. The upper lip 44 of the relatively rigid panel 41 is overlapped by the lower end 45 of the flexible panel 44, which holds the lip 44 against the wall 42.

In FIG. 5, an alternative design for a relatively rigid panel 51 is provided, such that an upstanding lip 54 thereof is engaged by the separate relatively flexible attachment member 50, holding the lip 54 against the building wall 52, and the relatively flexible attachment member 50, is, in turn, fastened to the building wall 52 via suitable staples 53 or the like.

Figure 6:
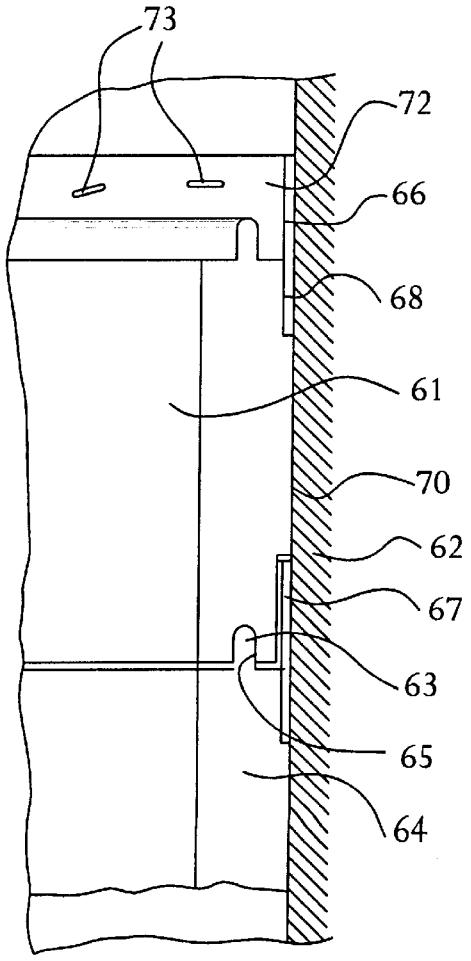

With reference now to FIG. 6, there is shown an alternative type of relatively rigid covering panels 61, in the form of hardboard panels 61 applied to a building wall 62.

The panels 61 are of the type having tongue-and-groove interconnections at upper and lower edges thereof, such as with the tongue 63 of a lower panel 64 in engagement in a grove 65 of the upper panel 61. The panels 64, 61, comprise the relatively rigid panels in this embodiment, and they, in turn, are provided with relatively flexible attachment members 66, 67, secured in some appropriate manner, such as by glue or other adhesives, into notches such as that 68 at the upper end, and in the rear surface 70 of the relatively rigid panels, such as that 61. The nailing hem 72 of the relatively flexible attachment member 66 is suitably fastened to the wall 62 by means of suitable nails, staples or the like 73.

Figure 7:
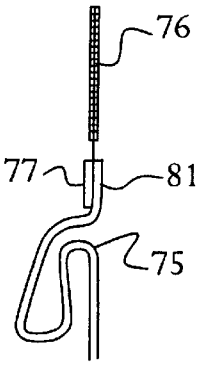
FIG. 7 is a fragmentary side or edge view of an upper edge of siding, wherein the nailing hem is shown as comprising a relatively flexible siding member of the fabric type secured to the relatively rigid panel member, in sandwiched relation thereto.
Figure 8:
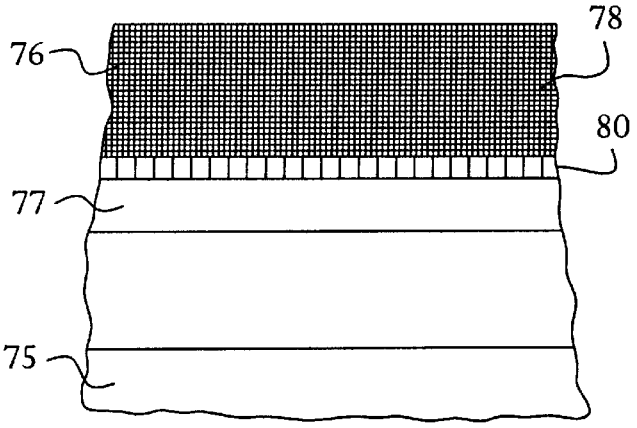
FIG. 8 is a left, frontal elevational view of the siding illustrated in FIG. 7, presented as a fragmental illustration.

With reference to FIG. 7, the relatively rigid siding member 75 has a relatively flexible fabric member 76, generally of the woven type as shown in FIG. 8, the upper end 78 of which has a selvage connected to the relatively rigid member 75 by means of downwardly extending strands or threads 80, which, in turn are sandwiched between separate relatively rigid strip 77 and an upstanding lip 81 of member 75, as shown. The fabric 76 may be woven or non-woven, and it will be seen that the same can accommodate leftward and rightward movement of the relatively rigid member 75 (FIG. 8) due to changes in temperature and that the stands 80 and selvage 78 can accommodate such movement, while still being stapled or otherwise secured to a building wall or the like. Alternatively, the selvage 78 could be constructed to be relatively rigid, to be connected to the relatively rigid panel member 75 by means of the relatively flexible strands 80.

Figure 9:
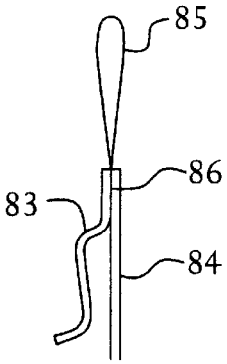
FIG. 9 is a view like that of FIG. 7, but wherein the fabric is a rolled fabric, sandwiched between two components of the relatively rigid panel member.

With reference now to FIG. 9, it will be seen that the relatively rigid panel member comprises panel components 83 and 84, with a rolled, inverted U-shaped rolled fabric portion 85 comprising the relatively flexible member, in clamped-together arrangement between the upstanding lips of the relatively rigid panel components 83 and 84, as shown at 86, and in either adhesive or non-adhesive securement therebetween.

Figure 10:
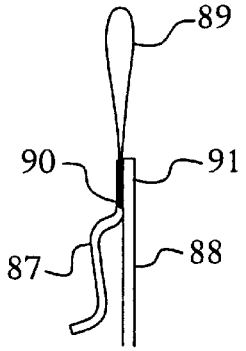
FIG. 10 is an illustration like that of FIG. 9, but wherein the rolled fabric is illustrated as being co-extruded with the left-most one of the components of the relatively rigid panel member.

With reference to FIG. 10, it will be seen that the relatively rigid panel member is likewise comprised of relatively rigid components 87 and 88, with the rolled fabric or otherwise constructed relatively flexible member 89 being shown in co-extruded relation with component 87, as at 90, and adhesively or otherwise secured to the upper lip 91 of component 88, as shown.

Figure 11:
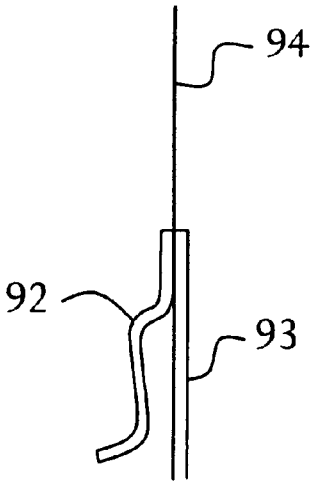
FIG. 11 is an illustration like that of FIGS. 7, 9 and 10 but wherein the relatively flexible siding member is a fabric or sheet of other flexible material, sandwiched between two components of a relatively rigid panel member.

With reference to FIG. 11, it will be seen that the relatively rigid components 92, 93 of the relatively rigid panel member have a fabric or other relatively flexible attachment member 94 adhesively secured therebetween, as shown.

Figure 12:
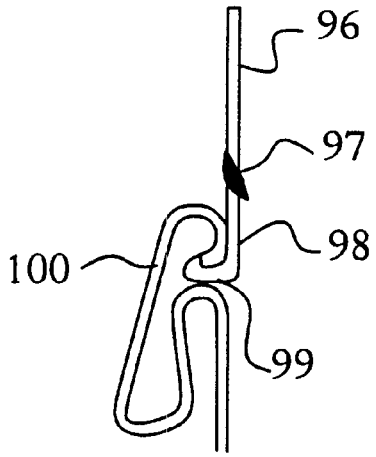
FIG. 12 is an illustration like that of FIG. 11, but wherein the relatively flexible siding member is fused along a fusion line to a relatively rigid member at the lower end thereof, having a leftwardly facing barb in engagement with portions of a relatively rigid panel member.

With reference to FIG. 12, it will be seen that the relatively flexible attachment member 96 is co-extruded as at 97, or otherwise connected to a generally relatively rigid member 98, having a leftwardly-facing barb 99, as shown, in snapped-in engagement in a rightwardly facing opening of the relatively rigid panel member 100, as shown. The barb 99 may be of any desired length into and out of the plane of the paper of FIG. 12, even the full length of the siding.

Figure 13:
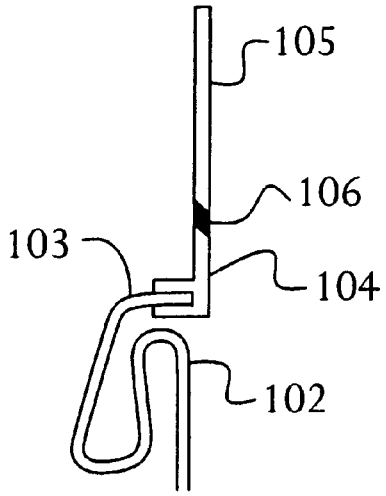
FIG. 13 is an illustration like that of FIG. 12, but wherein the relatively flexible siding member is connected along a line of fusion, co-extruded or otherwise secured to a leftwardly facing grooved portion at the lower end thereof, which receives a portion of the relatively rigid panel member in tongue-and-groove relation therewith.

With reference to FIG. 13, it will be seen that the relatively rigid panel member 102 has a rightwardly-facing tongue 103, in tongue-and-groove interengagement, preferably adhesively or clampingly connected therein, to a relatively rigid lower end 104 of the relatively flexible attachment member 105, co-extruded or adhesively secured thereto at 106. Alternatively, the lower end 104 may also be constructed to be relatively flexible, such as of a rubber-like type, having a leftwardly facing groove adapted to accommodate the tongue 103 of relatively rigid member 102. The tongue 103, like the barb 99 of FIG. 12, may be of any desired length.

Figure 14:
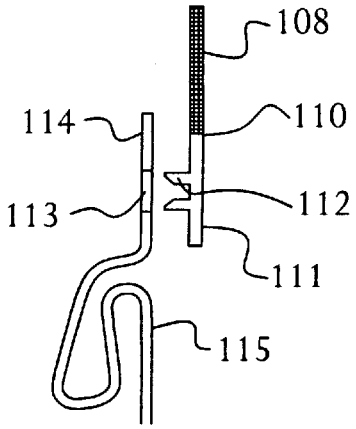
FIG. 14 is a side or edge elevational view of a relatively flexible siding member, fused or otherwise secured to a relatively rigid rivet-forming portion at the lower end thereof, shown relative to a relatively rigid panel member having a hole therein, with the two members being shown in exploded view and adapted to be brought together in connected relation.
Figure 15:
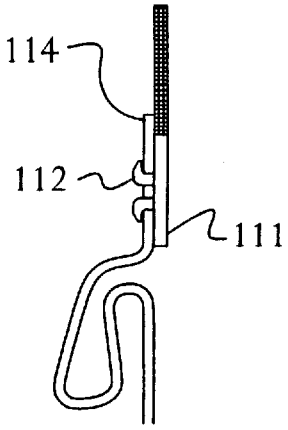
FIG. 15 is view of like that of FIG. 14, but wherein the two members are shown riveted together in connection relation.

With reference to FIGS. 14 and 15, it will be seen that the relatively flexible attachment member 108, is co-extruded or otherwise secured to a relatively rigid rivet portion 111, as at 110, with leftwardly-facing rivet portions 112 adapted to be received in a opening 113 of an upwardly extending lip 114 of a relatively rigid panel member 115. In FIG. 15, the rivet portions 112 are illustrated received in the opening 113, and hammered or otherwise bent over for securement of portion 111 to lip 114, in riveted engagement therewith.

Figure 16:
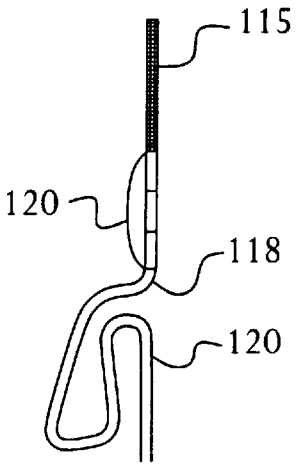
FIG. 16 is side or edge view like that of FIG. 15, but wherein the relatively flexible siding member is shown in fused or otherwise connected relation to a relatively rigid portion at the lower end thereof, shown in riveted connected relation with the upper end of a relatively rigid panel member.
Figure 17:
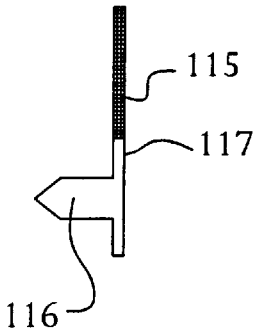
FIG. 17 is an illustration of a relatively flexible siding member shown in fused or otherwise connected relation to a relatively rigid portion adapted to be riveted to a relatively rigid panel member, as shown in FIG. 16.

With reference to FIG. 16, it will be seen that the relatively flexible attachment member 115, having its leftwardly extending rivet portion 116 (FIG. 17) secured thereto along a co-extrusion or other attachment line 117, which rivet portion 116 is shown in received engagement through an upper lip 118 of relatively rigid panel member 120, with the rivet portion 116 being shown in hammered-over engagement at 120, securing the relatively flexible and relatively rigid members together.

Figure 18:
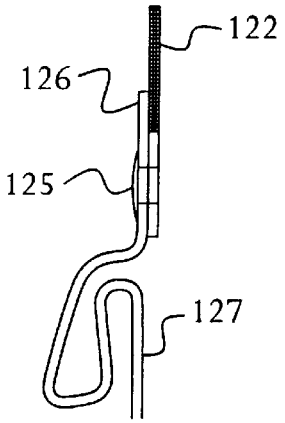
FIGS. 18 and 19 are illustrations similar to those of FIGS. 16 and 17, respectively, but wherein alternative rivet construction is illustrated.
Figure 19:
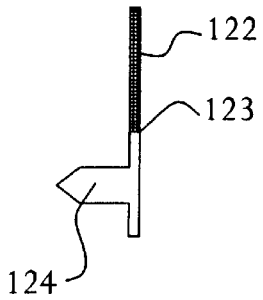

With reference to FIGS. 18 and 19, it will be seen that the relatively flexible attachment member 122, also secured along co-extrusion or other connection line 123, has an alternative rivet portion 124 received through and in hammered-over engagement at 125 with an upwardly extending lip 126 of the relatively rigid panel member 127.

Figure 20:
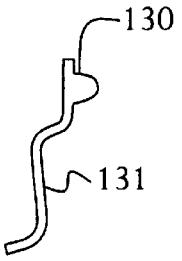
FIG. 20 is a side or edge elevational view of an upper portion of a relatively rigid panel member, having a rightwardly-facing rivet portion.

In FIG. 20 an alternative rivet arrangement is shown in the form of a rightwardly facing rivet portion 130 at the upward end of the relatively rigid front component 131 of the relatively rigid panel member.

Figure 21:
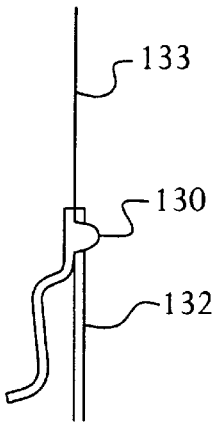
FIG. 21 is an illustration of a relatively rigid panel member as shown in FIG. 20, in riveted engagement with another relatively rigid panel member, sandwiching a relatively flexible siding member therebetween, the siding member being of fabric, woven, or other flexible or stretchable material.

In FIG. 21 the rivet portion 130 is shown in received engagement through an opening (not shown) at the upper end of the relatively rigid panel member 132, clampingly securing a relatively flexible rubber, fabric or other flexible attachment member 133 therebetween.

Figure 22:
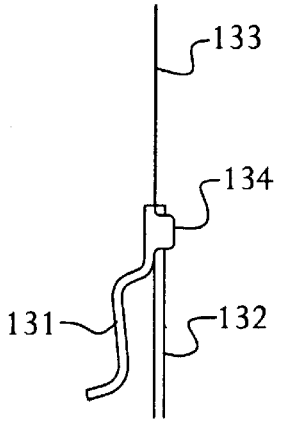
FIG. 22 is an illustration like that of FIG. 21, but wherein the rivet portion of the member illustrated in FIG. 20 is shown in completed riveted arrangement.

In FIG. 22, the arrangement of FIG. 21 is also illustrated, with the rivet portion 130 being shown in hammered-over engagement securing the relatively rigid panel components 131 and 132 together with the relatively flexible attachment member 133 therebetween.

Figure 23:
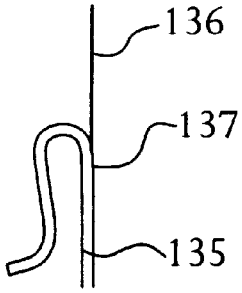
FIG. 23 is a side or edge elevational view of an upper edge of siding, whereby the nailing hem is shown as comprising a relatively flexible siding member of the fabric or other type, in sealed, glued, or other adhesive securement to the relatively rigid panel member.

With reference to FIG. 23, it will be seen that the relatively rigid panel member 135 has a relatively flexible fabric, rubber or other flexible pliant attachment member 136 secured thereto either by co-extrusion or adhesive or other attachment at location 137, as shown.

Figure 24:
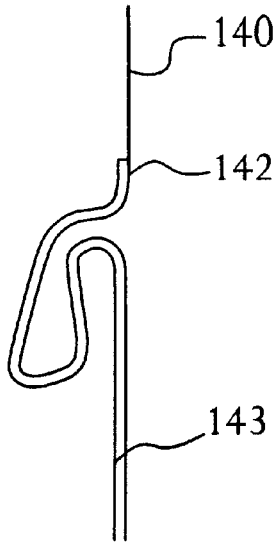
FIG. 24 is an illustration like that of FIG. 23, wherein the upper end of the relatively rigid panel member has a different configuration.

In FIG. 24, like FIG. 23, there is illustrated a similar manner of attachment of the relatively flexible attachment member 140 the relatively rigid panel member 141, by means of either co-extrusion, adhesive connection, or other connection, at 142 as shown.

In FIG. 25, the relatively rigid panel member 145 has an upward extending lip 146, which is held against a wall (not shown) or the like, by means of a downwardly extending lip 147 that may be flexible or rigid, but wherein the relatively flexible attachment member 148 is shown connected to the downwardly extending lip 147 by means of co-extrusion, adhesive attachment, or otherwise secured thereto, as at 150.

As discussed above, the relatively flexible attachment members may be fastened to a building wall by means of adhesives or the like, such as, by employing an adhesive on the surface that is to be applied to the wall, perhaps by a strip of removable release paper or the like, which, once removed, leaves a tacky surface ready for application to a building wall by simply placing the same thereagainst. It will further be understood that various other types of fasteners, other than adhesives, nails, staples or the like, may be used as fasteners for fastening the relatively flexible attachment members to a building wall. It will further be understood that the relatively flexible attachment members may be separate members as in the case of embodiments of FIGS. 4 and 5, or may be made integral therewith, as in the case of the embodiment of FIGS. 2–3 and 6. Where the flexible members are made integral with the rigid panel members, such may be done by various techniques, such as gluing, melting together, sonic welding, heat fusion, co-extrusion, etc., or by any other means, even mechanical fastening means, such as stapling the relatively flexible member to the relatively rigid member (not shown). It will further be understood that the materials of construction of the relatively flexible members may be varied, to include rubber-like materials, fabrics, relatively flexible sheet materials, or like pliant material, and that such may be co-extensive in horizontal length with the relatively rigid panels, as shown herein, or may be comprised of relatively short strips, nailing hems, or tabs (not shown), or the like. Additionally, the relatively rigid panels may take on various forms other than those specifically disclosed herein, and may comprise siding panels, roofing panels or the like, comprised of vinyl, aluminum, other sheet metals or thermoplastics, or even wood or the like, as desired. Thus, it will be apparent from the foregoing that various modifications may be made in the details of constructions, as well as in the use and operation of the exterior covering, assembly and components thereof of the present invention, all within the spirit and scope of the invention as defined in the appended claims.

What is claimed is:

1. An exterior covering assembly for covering building surfaces and the like comprising:

(a) a plurality of rigid covering panels for covering at least a portion of a building surface with each said panel having an upper edge zone;

(b) a plurality of relatively flexible plaint attachment members formed of a plaint material for attaching relatively rigid panels to the building surface while in engagement with said panels; said relatively flexible attachment members being integral with said relatively rigid panels along said upper edge zones of said relatively rigid panels; and (c) a plurality of fastener means for fastening relatively flexible attachment members to the building surface; wherein (d) said relatively flexible attachment members comprising means operationally connecting said relatively rigid covering panels and said fastener means, for indirectly attaching said panels to a building surface via said relatively flexible attachment members;

(e) whereby expansion and contraction of said relatively rigid covering panels with variations in temperature is accommodated by the flexibility of said relatively flexible attachment members.

2. The covering assembly of claim 1, whereby the expansion and contraction of said relatively rigid covering panels is accommodated by said relatively flexible attachment members without interfering with the attachment of said fastener members to the building surface.

3. The covering assembly of claim 1, wherein the flexibility of said relatively flexible attachment member is different and greater than any flexibility of said relatively rigid covering panels.

4. The covering assembly of any one of claims 1–3, wherein said attachment members are integrally connected with said panels.

5. The covering assembly of any one claims 1–3, wherein said relatively flexible attachment members are separate from said panels.

6. The covering assembly of any one of claims 1–3, wherein said relatively flexible attachment members comprise fabric members.

7. The covering assembly of any one of claims 1–3, wherein the relatively flexible attachment members comprise woven members.

8. The covering assembly of any one of claims 1–3, wherein said relatively flexible attachment members are attached to said relatively rigid panel members.

9. The covering assembly of any one of claims 1–3, wherein said operationally connecting means comprise a co-extrusion of said relatively flexible attachment members to said to relatively rigid panels.

10. The covering assembly of any one of claims 1–3, wherein said operationally connecting means comprise a sandwiched engagement of said relatively flexibly attachment members to said relatively rigid panels.

11. The covering assembly of any one of claims 1–3, wherein said operationally connecting means comprise adhesive engagement of said relatively flexible attachment members to said relatively rigid panels.

12. The covering assembly of any one of claims 1–3, wherein said operationally connecting means comprise mechanical engagement of said relatively flexible attachment members to said relatively rigid panels.

13. The covering assembly of any one of claims 1–3, wherein said operationally connecting means comprise barbed engagement of said relatively flexible attachment members to said relatively rigid panels.

14. The covering assembly of any one of claims 1–3, wherein said operationally connecting means comprise tongue-and-groove engagement of said relatively flexible attachment members to said relatively rigid panels.

15. The covering assembly of any one of claims 1–3, wherein said operationally connecting means comprise riveted engagement of said relatively flexible attachment members to said relatively rigid panels.

16. An exterior covering panel for application to a building surface by fastener means, comprising a relatively rigid panel portion having an upper edge zone and a relatively flexible pliant panel portion formed of a pliant material secure with said relatively rigid panel portion and being integral therewith along said upper edge zone of said relatively rigid panel, and comprising means whereby expansion and contraction of said relatively rigid panel portion with variations in temperature is accommodated by the flexibility of said relatively flexible portion.

17. The panel of claim 16, wherein the expansion and contraction of said relatively rigid panel portion is accommodated by said relatively flexible panel portion without interfering with the attachment of the panel portion to the building surface by a fastener means.

18. A method of covering a building surface comprising the steps of:

(a) providing a plurality of relatively rigid covering panels for cover at least a portion of a building surface with each said panel having an upper edge zone;

(b) providing a plurality of relatively flexible pliant attachment members for attaching relatively rigid panels to the building surface while in engagement with said panels; said relatively flexible attachments member being integral with said relatively rigid panels along said upper edge zones of said relatively rigid panels;

(c) providing a plurality of fastener means for fastening relatively flexible attachment members to the building surface; and (d) operationally connecting said relatively rigid covering panels and said fastener means, for indirectly attaching said panels to a building surface via said relatively flexible attachment members.

19. The method of claim 18, whereby expansion and contraction of said relatively rigid covering panels with variations in temperature is accommodated by the flexibility of said relatively flexible attachment members, without interfering with the attachment of said fastener members to the building surface.

20. The method of claim 18, wherein the step of providing relatively flexible attachment members comprises providing attachment means of different flexibility than any flexibility of said relatively rigid covering panels.

21. The method of any one of claims 18–20, wherein the step of providing relatively flexible attachment members comprises providing fabric members.

22. The method of any one of claims 18–20, wherein the step of operationally connecting relatively rigid covering panels comprises co-extruding relatively flexible attachment members to the relatively rigid covering panels.

23. A siding panel comprising:

a vinyl sheet having an upper edge; and a fabric hem affixed to the upper edge of the vinyl sheet.

24. The siding panel of claim 23, further comprising means for sandwiching the fabric hem to the vinyl sheet.

25. A method for installing a vinyl siding panel on a structure, the method comprising the steps of:

attaching a fabric hem to an edge of the siding panel; and attaching the hem to the structure.

26. The method for installing a vinyl siding panel of claim 25, wherein the step of attaching the hem to the edge of the siding panel further comprises the step of laminating the hem to the edge of the siding panel.

* * * * *